US010712037B2

(12) United States Patent
Brahme et al.

(10) Patent No.: US 10,712,037 B2
(45) Date of Patent: Jul. 14, 2020

(54) DEHUMIDIFICATION TECHNIQUE FOR HEATING VENTILATION AND AIR CONDITIONING SYSTEMS

(71) Applicant: Lennox Industries Inc., Richardson, TX (US)

(72) Inventors: Rohini Brahme, Irving, TX (US); Umesh Gokhale, Irving, TX (US); Derek Phillips, Dallas, TX (US)

(73) Assignee: Lennox Industries Inc., Richardson, TX (US)

( * ) Notice: Subject to any disclaimer, the term of this patent is extended or adjusted under 35 U.S.C. 154(b) by 134 days.

(21) Appl. No.: 15/939,439

(22) Filed: Mar. 29, 2018

(65) Prior Publication Data

US 2019/0301762 A1 Oct. 3, 2019

(51) Int. Cl.

| | |
|---|---|
| ***F24F 11/46*** | (2018.01) |
| ***F24F 11/88*** | (2018.01) |
| ***F24F 11/89*** | (2018.01) |
| *F24F 110/20* | (2018.01) |
| *F24F 110/10* | (2018.01) |

(52) U.S. Cl.

CPC ..... *F24F 11/46* (2018.01); *F24F 11/88* (2018.01); *F24F 11/89* (2018.01); *F24F 2110/10* (2018.01); *F24F 2110/20* (2018.01)

(58) Field of Classification Search

CPC .. F24F 11/46; F24F 11/88; F24F 11/89; F24F 2110/20; F24F 2110/10

See application file for complete search history.

(56) References Cited

U.S. PATENT DOCUMENTS

| | | | | |
|---|---|---|---|---|
| 3,938,348 A * | 2/1976 | Rickert | F24F 1/027 | 62/97 |
| 2008/0098756 A1* | 5/2008 | Uselton | F24F 3/153 | 62/173 |
| 2012/0060523 A1* | 3/2012 | Hung | F25B 5/00 | 62/93 |
| 2012/0174922 A1* | 7/2012 | Virr | A61M 16/0066 | 128/203.12 |

(Continued)

FOREIGN PATENT DOCUMENTS

JP 2014196879 A * 10/2014

*Primary Examiner* — Thomas C Lee
*Assistant Examiner* — Michael Tang
(74) *Attorney, Agent, or Firm* — Baker Botts L.L.P.

(57) ABSTRACT

According to certain embodiments, operating an HVAC system comprises receiving zone temperature data from a temperature sensor, zone humidity-ratio data from a humidity sensor, a temperature set point from a user, and a relative-humidity set point from a user. A humidity-ratio set point is determined based on the temperature and relative-humidity set points. A first command to the HVAC system to perform a cooling operation is communicated upon determining that the temperature data exceeds a temperature threshold based on the temperature set point. Determining if the humidity data has reached a humidity-ratio threshold based on the humidity-ratio set point after determining that the temperature data has reached the temperature threshold. Operating the HVAC system according to a dehumidification-based cooling procedure upon determining that the humidity data has not reached the humidity-ratio threshold.

20 Claims, 3 Drawing Sheets

(56) References Cited

U.S. PATENT DOCUMENTS

2013/0317655 A1* 11/2013 Shah ..... F24D 19/1048
700/276
2014/0298880 A1* 10/2014 Pursifull ..... G01N 33/0006
73/1.06

* cited by examiner

DEHUMIDIFICATION TECHNIQUE FOR HEATING VENTILATION AND AIR CONDITIONING SYSTEMS

TECHNICAL FIELD

Certain embodiments of the present disclosure relate generally to dehumidification techniques for heating ventilation and air conditioning (HVAC) systems.

BACKGROUND

Heating ventilation and air conditioning (HVAC) systems may be used to regulate the temperature and humidity of a conditioned space. In conventional HVAC systems, users may input a desired temperature set point and a desired relative humidity set point based on the users' preferences. Relative humidity is determined relative to the dry bulb temperature and is generally based on the ratio of actual water vapor density to the saturation water vapor density. The relative humidity set point may be expressed as a percentage. Conventional systems will operate the HVAC components to try and meet the demands of both the temperature and relative humidity set points.

SUMMARY OF THE DISCLOSURE

According to certain embodiments, a heating ventilation and air conditioning (HVAC) system comprises a controller, a temperature sensor, and a humidity sensor. The temperature sensor is configured to communicate the temperature of a zone to the controller and the humidity sensor is configured to communicate the humidity-ratio of the zone to the controller. The controller is configured to receive temperature data from the temperature sensor, humidity data from the humidity sensor, a temperature set point from a user, and a relative-humidity set point from a user. The controller is further configured to determine a humidity-ratio set point based on the temperature set point and relative-humidity set point, communicate a first command to the HVAC system to perform a cooling operation after determining that the temperature data exceeds a temperature threshold based on the temperature set point, determine if the humidity data has reached a humidity-ratio threshold based on the humidity ratio set point after determining that the temperature data reached the temperature threshold, and operate the HVAC system according to a dehumidification-based cooling procedure after determining that the humidity data has not reached the humidity-ratio threshold.

In some embodiments, the dehumidification-based cooling procedure comprises performing the cooling operation until the humidity-ratio threshold has been reached. In some embodiments, the dehumidification-based cooling procedure comprises determining that the humidity-ratio threshold is unattainable and then determining not to perform the cooling operation.

In some embodiments, the controller is configured to determine whether to operate the HVAC system according to a first mode of operation that uses relative-humidity to determine whether to perform dehumidification or a second mode of operation that uses humidity-ratio to determine whether to perform dehumidification based on a user selection. In some embodiments, the HVAC system may then operate according to the selected mode. In some embodiments, the first mode of operation comprises calculating relative-humidity data based at least on the humidity data and then operating the HVAC system according to an over-cooling operation if the relative humidity-data has not reached a relative humidity threshold based on the relative-humidity set point. In some embodiments, the controller is further configured to perform a plurality of energy savings calculations based at least in part on whether the first mode of operation or the second mode of operation is selected, and to then display the energy savings calculations.

In some embodiments, the dehumidification-based cooling procedure comprises determining that a temperature of an evaporator coil is above a dew point and, in response, determining not to perform the cooling operation.

In certain embodiments, a method of operating an HVAC system comprises receiving zone temperature data from a temperature sensor, zone humidity-ratio data from a humidity sensor, a temperature set point from a user, and a relative-humidity set point from a user. A humidity-ratio set point is determined based on the temperature and relative-humidity set points. The method comprises communicating a first command to the HVAC system to perform a cooling operation. The first command is communicated upon determining that the temperature data exceeds a temperature threshold that is based on the temperature set point. After determining that the temperature data has reached the temperature threshold, the method further comprises determining if the humidity data has reached a humidity-ratio threshold that is based on the humidity-ratio set point. The method further comprises operating the HVAC system according to a dehumidification-based cooling procedure upon determining that the humidity data has not reached the humidity-ratio threshold.

Certain embodiments may provide one or more technical advantages. As an example, certain embodiments provide advantages to the efficiency and energy usage of HVAC systems. A desired level of comfort of a conditioned space may be attained without removing excess moisture from the conditioned space and continuously operating the HVAC system beyond the appropriate amount. As another example, certain embodiments provide the advantage of improved reliability and reduced wear on HVAC system by decreasing total operating time of the system. Certain embodiments may include all, some, or none of the above-described advantages. Other advantages will be apparent to those of ordinary skill in the art.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
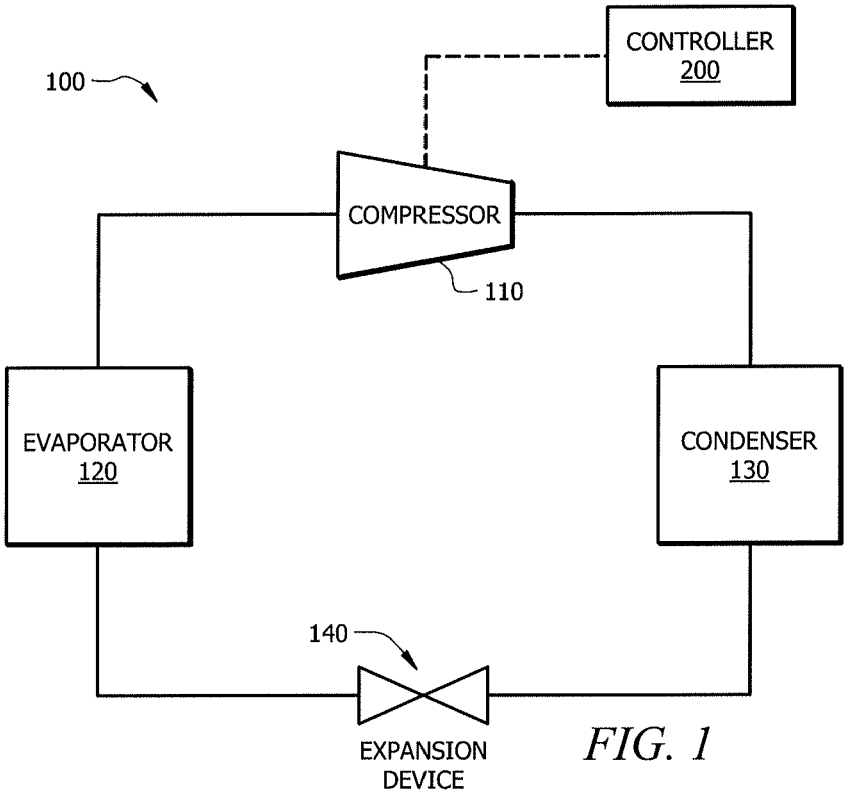
FIG. 1 is a block diagram illustrating an example HVAC system, in accordance with certain embodiments.

Embodiments of the present disclosure and its advantages are best understood by referring to FIGS. 1 through 4 of the drawings, like numerals being used for like and corresponding parts of the various drawings.

Heating ventilation and air conditioning (HVAC) systems, such as heat pump systems, air conditioning systems, combined heating-and-air conditioning systems, and refrigeration systems, each function to condition a space. As an example, an HVAC system configured to perform air conditioning functionality may lower the temperature and remove humidity from the conditioned space. The HVAC system may achieve this desirable effect by employing a refrigeration cycle. By compressing a refrigerant and circulating the compressed refrigerant through the HVAC system, usually first through a condenser, then through an expansion device, and lastly through an evaporator before returning to the compressor, cooling may be achieved within the conditioned space. Air present in an air duct surrounding the cold surface of the evaporator will experience a reduction in temperature resulting from the transfer of thermal energy out of the air and into the refrigerant circulating within the evaporator coil. An indoor fan or a blower fan may drive air over the cold evaporator, carrying now-cooled air away from the evaporator and into the conditioned space.

Not only do HVAC system reduce the temperature of air sent to a conditioned space, but they also may act to remove humidity from the air as it passes over the evaporator. It is desirable to control the humidity of a conditioned space for comfort of occupants. Too much humidity can also lead to health and environmental problems in the conditioned space, such as rotting of a building structure and presence of mold and other allergens. Dehumidification of air may be achieved through removing water vapor from the air as it passes over the HVAC system's evaporator. If the evaporator is cooled to a temperature below the dew point, moisture in the air will condense on the evaporator's surface and may then be collected and removed.

Some HVAC systems may only allow a user to select a temperature set point which the system will attempt to meet. Other more sophisticated systems may allow a user to select both a temperature set point and a relative humidity set point. In such systems, the HVAC system will be configured to operate so as to meet both set points. For example, such HVAC systems may run in a refrigeration cycle to reduce the temperature and humidity of the conditioned space below the user-selected set points.

When running the HVAC system in the refrigeration cycle (whether for cooling purposes or dehumidification purposes), the temperature of the conditioned space is reduced. Reducing the temperature of the conditioned space makes it difficult for the system to meet the relative humidity set point. In particular, relative humidity is determined relative to the dry bulb temperature and is generally expressed as a percentage based on the ratio of actual water vapor density to the saturation water vapor density. However, because warm air can hold more water vapor and cold air can hold less water vapor, the relative humidity is a function of the temperature of the air. Thus, as the temperature of the conditioned space is reduced through the refrigeration cycle of the HVAC system, the relative humidity of the space may go up. Because the relative humidity of the air will continue to go up as the refrigeration cycle runs and thus the temperature further drops, the system may never be successful in reaching the selected relative humidity set point.

Operating the HVAC system continuously in an effort to reach the selected relative humidity set point, numerous undesirable effects may result. For instance, the HVAC system may operate inefficiently, using more energy than necessary because of its always-on state. The HVAC system may remove more humidity than desirable by chasing a moving relative humidity. When there is very low humidity it can cause warping to wood in the structure and can be uncomfortable to occupants leading to dry skin, static electricity, and respiratory issues.

Humidity ratio is another measure of humidity in the air, but unlike relative humidity, humidity ratio is an absolute value. Humidity ratio is the actual mass of water vapor in the air to the mass of the dry air and is expressed as kilograms of water vapor per kilogram of dry air or pounds of water vapor per pounds of dry air.

As discussed above, certain HVAC systems provide users with the option of configuring a humidity set point. Such systems allow the user to configure the set point in terms of relative humidity. Because relative humidity is typically expressed in terms of a percentage, it tends to be understandable to users. For example, users may be used to weather reports that describe humidity in terms of a percentage (i.e., relative humidity). By contrast, humidity ratio is generally expressed in terms of numeric values that are not intuitive or meaningful to lay users. Examples of humidity ratios may include numeric values in the range of approximately 0.008 to 0.01. Typical HVAC systems do not provide users with the option of configuring the humidity ratio because the values are not user-friendly, understandable, or relatable to lay users.

FIG. 1 illustrates an example HVAC system. As illustrated in FIG. 1, an HVAC system 100 may be employed to carry out a vapor-compression refrigeration cycle. The system 100 may operate with a compressor 110 to drive the thermodynamic refrigeration cycle. In certain embodiments, the compressor 110 pumps the refrigerant gas up to a high pressure and temperature and moves the hot refrigerant to the condenser 130. The condenser 130 may be a device used to transfer heat from the refrigerant to the surrounding environment and in so doing, cool the refrigerant. In some embodiments, after being cooled by passing through the condenser 130, the refrigerant will pass through an expansion device 140. The expansion device 140 may be a metering device such as a thermal expansion valve. In certain embodiments, the expansion device 140 may case a pressure drop in the refrigerant. With this pressure drop may come a decrease in the temperature of the refrigerant.

In certain embodiments, after the drop in pressure and resulting drop in temperature of the refrigerant after passing through the expansion device 140, the refrigerant may pass through evaporator 120. The cold refrigerant passing through evaporator 120 may draw heat out of the air passing over the evaporator 120. This may warm the refrigerant, causing it to evaporate within the evaporator 120. The air surrounding the evaporator 120 will be cooled as a result and may be used to condition air sent to a zone. Moisture in the air may also be drawn out of the air by the evaporator 120 if the temperature of the evaporator 120 is below the dew point of the air. In certain embodiments, the refrigerant within the HVAC system 100 may then continue from the evaporator 120 back to the compressor 110, completing the cycle of HVAC system 100.

In certain embodiments, HVAC system 100 may also comprise a controller 200. In some embodiments the controller 200 may be communicatively coupled to one or more components of HVAC system 100. For example, the controller 200 may be communicatively coupled to compressor 110 to control the operation of HVAC system 100. Controller 200 will be described in more detail with reference to FIG. 2.

Figure 2:
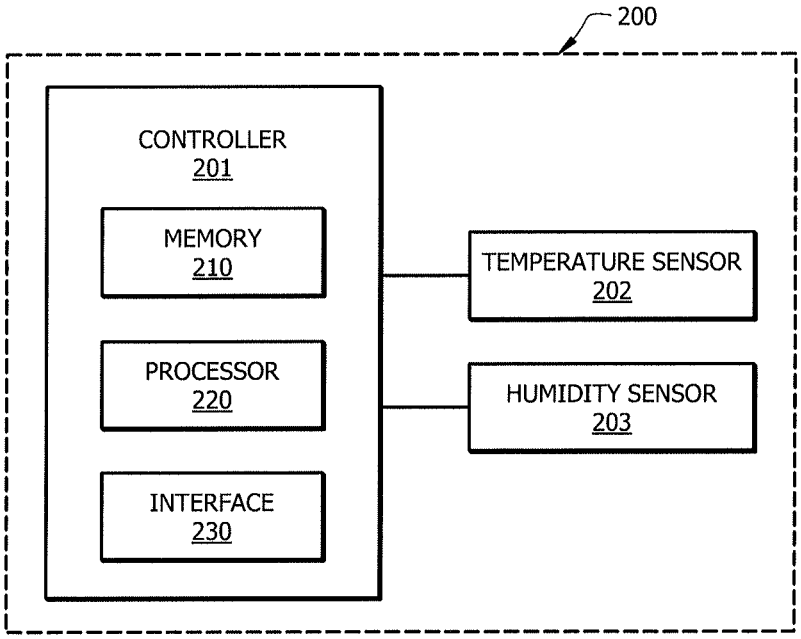
FIG. 2 is a block diagram illustrating an example controller, in accordance with certain embodiments.

Referring now to FIG. 2, HVAC system 100 may include one or more controllers. For example, HVAC system 100 may have a first controller 200 and a second controller 201 configured for controlling HVAC functions. In certain embodiments, controller 200 may be referred to as a thermostat. In certain embodiments, controller 200 may comprise controller 201 and one or more sensors 202 and 203. In some embodiments, sensor 202 may be a temperature sensor and sensor 203 may be a humidity sensor.

In some embodiments, temperature sensor 202 may be a thermistor, a resistance temperature detector, a thermocouple, a semiconductor-based temperature sensor, or any other type of sensor commonly used in HVAC system. Temperature sensor 202 may be configured to communicate temperature data of a zone to controller 200 or controller 201. In some embodiments, humidity sensor 203 may be a capacitive humidity sensor, a resistive humidity sensor, a thermal conductivity humidity sensor, or any other type of sensor commonly used in HVAC systems. Humidity sensor 203 may be configured to communicate humidity data as a percentage representing the relative humidity of a zone to controller 200 or controller 201. Alternatively, humidity sensor 203 may be configured to communicate humidity data as a numeric value representing the humidity ratio of the zone to controller 200 or controller 201 (and controller 200 or controller 201 may be configured to determine the relative humidity based on the humidity ratio sensed by humidity sensor 203). Sensors 202 and 203 may be located within a housing of controller 200 or may be external to controller 200. For example, sensors 202 and 203 may be internal sensors disposed within a thermostat. As another example, sensors 202 and 203 may be external sensors located within a conditioned zone and configured to communicate remotely with controller 200 or controller 201.

In certain embodiments, controllers 200 or 201 may be configured to control operation of one, some, or all components within the system to meet a demand. In the illustrated embodiment of FIG. 2, controller 201 includes a memory 210, processing circuitry 220, and an interface 230. In an embodiment, controller 201 may comprise, or be coupled to, a computer-readable medium with memory 210 for storing control logic or instructions for operating HVAC system 100 components. Controller memory 210 may be a volatile or non-volatile memory of any known type commonly used in HVAC systems. Controller 201 may store computer executable instructions within memory 210. The computer executable instructions may be included in computer code. Controller 201 may be implemented with hardware, software, firmware, or any combination thereof.

Controller 201 may, additionally, be implemented with processing circuitry 220 for executing stored instructions. Controller 201 may be responsive to or operable to execute instructions stored as part of software, hardware, integrated circuits, firmware, micro-code or the like. The functions, acts, methods or tasks performed by controller 201, as described herein, may be performed by processing circuitry 220 executing instructions stored in memory 210. The instructions are for implementing the processes, techniques, methods, or acts described herein. Controller processing circuitry 220 may be any known type of processing circuitry commonly used in HVAC systems. The processing circuitry may be a single device or a combination of devices, such as associated with a network or distributed processing. Controller 201 may operably couple to HVAC system 100 components via wired or wireless connections.

Controllers 200 or 201 may receive data, which may comprise signals from one or more sensors 202 and 203. The data received by controller 201 may be received directly from one or more remote sensing devices, or, may be received indirectly through one or more intermediate devices such as a signal converter, processing circuitry, an input/output interface (e.g. network connectivity to HVAC system 100), an amplifier, a conditioning circuit, a connector, and the like. Controller 201 may operate system 100 components in response to received data from remote sensing devices. Additionally, controller 201 may operate HVAC system 100 components in response to user input, demands of the conditioned space, refrigerant or ambient air conditions, control logic, and the like.

Although FIG. 2 illustrates two controllers 200 and 201 for purposes of example and explanation, HVAC system 100 may have any suitable number of controllers. Functionality may be divided between the controllers in any suitable manner. As an example, in certain embodiments, HVAC system 100 may include a first controller configured to interface with a user, such as a thermostat, and a second controller configured to interface with components of the HVAC system 100, such as one or more of the components shown in FIG. 1. The first controller may send commands to the second controller, such as commands to operate the components of the HVAC system 100 in order to satisfy a desired temperature or humidity set point that the first controller receives from the user. The second controller may instruct components of the HVAC system 100 to turn on or off, increase or decrease speed, increase or decrease power, etc. in order to satisfy the desired temperature and/or humidity set points received from the first controller.

Figure 3:
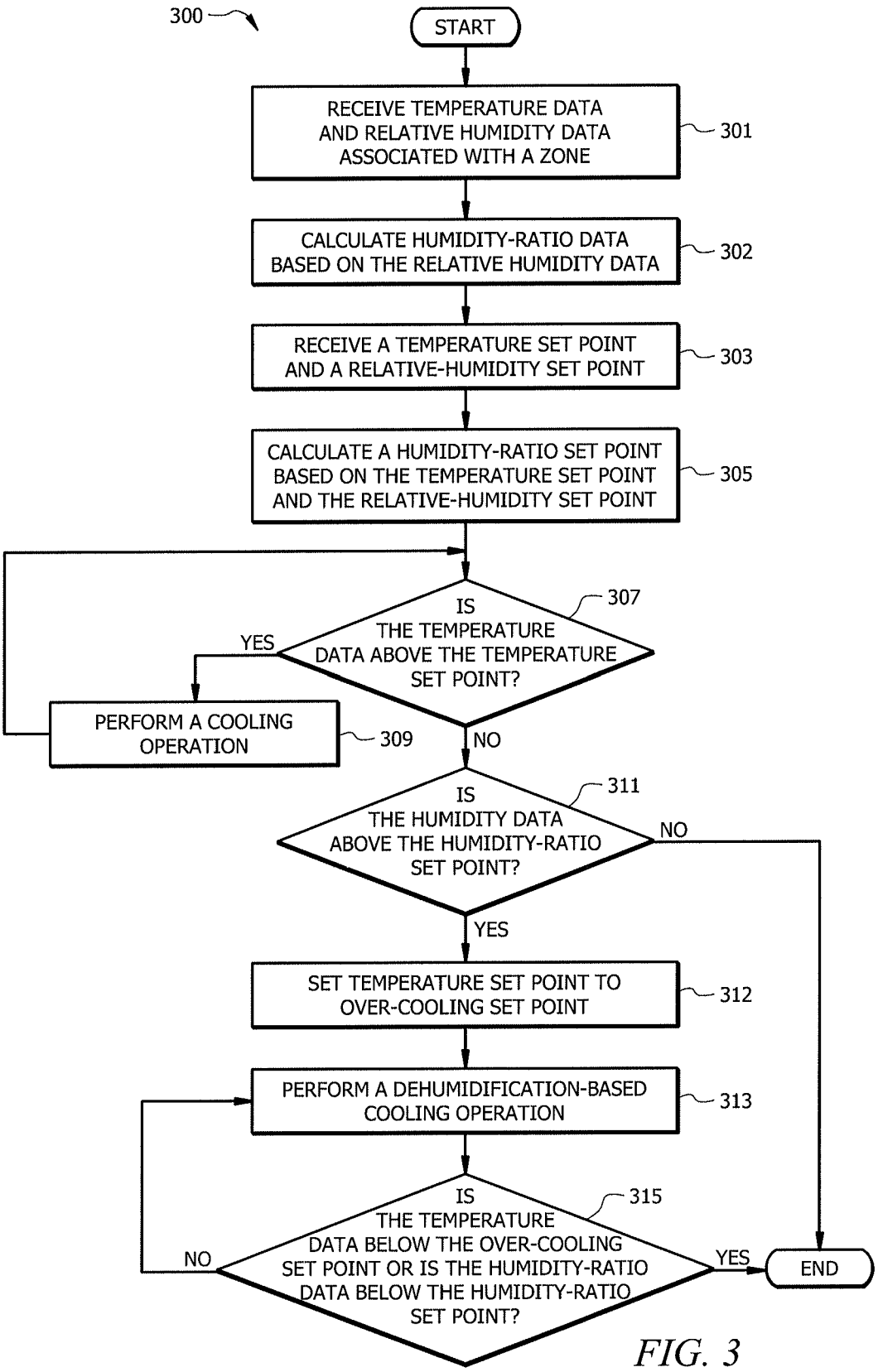
FIG. 3 is a flowchart illustrating a method that may be performed by an example HVAC system, in accordance with certain embodiments.

FIG. 3 illustrates an example method that may be performed by HVAC system 100. In particular embodiments, controller 200 or controller 201 may perform all of the steps of method 300. For simplicity, either controller 200 or controller 201 may be referred to simply as controller 200 for the following disclosed steps. In some embodiments, controller 200 initiates method 300 in step 301. In step 301, controller 200 may receive temperature data associated with a zone from a temperature sensor 202 and relative humidity data associated with a zone from a humidity sensor 203. In certain other embodiments, in step 301 controller 200 may receive relative humidity data from a humidity sensor 203.

In certain embodiments, HVAC system 100 may supply conditioned air to a single zone. For example, HVAC system 100 may supply conditioned air to an entire house. In other embodiments, HVAC system 100 may supply conditioned air to a plurality of zones. For example, a conditioned space could be configured into zones by floor, by room, or other suitable partitioning such that different zones can operate with different HVAC settings. In certain embodiments, zones may be repositionable zones. In certain embodiments, HVAC system 100 may comprise a plurality of temperature sensors and a plurality of humidity sensors. For example, an HVAC system 100 which services multiple zones may have a temperature sensor and a humidity sensor in each zone. In certain embodiments, HVAC system 100 may operate to cool each zone below a temperature set point for each zone and close a damper to cease cooling operations to the respective zone once the temperature data is below the temperature threshold. In certain embodiments, one zone will be selected by a user for controlling humidity based on the humidity data from the humidity sensor or sensors associated with that selected zone.

In step 302, controller 200 may calculate humidity-ratio data based on the relative humidity data and the temperature data received in step 301. In step 303, controller 200 may receive a desired temperature set point and a relative-humidity set point from a user. In certain embodiments, controller 200 may determine a temperature threshold based off of the temperature set point in order to provide a range of temperatures that will be acceptable as meeting the temperature set point. In certain embodiments, controller 200 may determine a relative humidity threshold based off of the relative humidity set point in order to provide a range of relative humidity that will be acceptable as meeting the relative humidity set point.

In step 305, controller 200 may calculate a humidity ratio set point based on the temperature set point and the relative humidity set point received in step 303. In certain embodiments, the humidity ratio set point will be a fixed value based on calculating the mass of water vapor in the air to the mass of the dry air for air having characteristics defined by the temperature set point and the relative humidity set point. Because the humidity ratio set point is a fixed number this will be more consistent when used with the humidity ratio data from the humidity sensor rather than relative humidity of the air which will be influenced by the temperature of the air at the time the reading is performed by the humidity sensor. In certain embodiments, the humidity ratio set point may be received from a user input. In certain embodiment, controller 200 may determine a humidity ratio threshold based off of the humidity ratio set point in order to provide a range of humidity ratio that will be acceptable as meeting the humidity ratio set point.

It is understood that the temperature, relative humidity, and humidity ratio thresholds described above may each comprise a range of values based on the respective set point or may be the same as the set point itself. It is further understood that where the determined thresholds provide a range based on the set point, the thresholds may be used by controller 200 in place of the respective set points. The use of thresholds to represent the set points may be beneficial to achieving improved operation of HVAC system 100 by minimizing the number of cycles HVAC system performs and reducing total operation time of HVAC system 100. As an example, in certain embodiments, the temperature threshold may be determined dynamically based on the ambient temperature, the capabilities and/or configuration of HVAC system 100, the rate of change of the temperature in the conditioned space, or other suitable factors. In certain embodiments, the temperature threshold may be determined according to Proportional Integral (PI) or Proportional Integral Derivative (PID) control techniques. Such techniques may turn on components of the HVAC system 100 in order to begin cooling toward the desired temperature set point. Once the temperature threshold has been reached, the PI or PID techniques may turn off components of the HVAC system 100 in order to allow the temperature to coast toward the desired temperature set point. In some embodiments, in step 307, controller 200 may determine whether the temperature data is above the temperature threshold (i.e., the threshold that is based on the temperature set point). For purposes of simplicity, FIG. 3 illustrates an example in which the temperature threshold is the same as the temperature set point. If the temperature data is above the temperature set point, then controller 200 may proceed to step 309. Otherwise if the temperature data is not above the temperature set point, then controller 200 may proceed to step 311.

In step 309, controller 200 may communicate a command to the HVAC system to perform a cooling operation. For example, the cooling operation may comprise operating the HVAC system to perform a vapor compression refrigeration cycle, however, other processes for cooling a space are contemplated. In certain embodiments, the cooling operation in step 309 may be performed for a predetermined amount of time before returning to step 307. In certain embodiments, the cooling operation in step 309 may be performed until the temperature data from the temperature sensor is no longer above the temperature set point.

In some embodiments, in step 311, controller 200 may determine whether the humidity data in the form of humidity ratio data is above the humidity ratio threshold (i.e., the threshold that is based on the humidity ratio set point). For purposes of simplicity, FIG. 3 illustrates an example in which the humidity ratio threshold is the same as the humidity ratio set point. If the humidity data is above the humidity ratio set point then controller 200 may proceed to step 312, otherwise if the humidity data is not above the humidity ratio set point then controller 200 may end method 300.

In step 312, controller 200 may set an over-cooling set point based in part on the temperature set point. The over-cooling set point may be a temperature within a certain limit below the temperature set point. For example, for an HVAC system 100 with a temperature set point of 75° F. and a 3° F. over cooling limit, the overcooling temperature set point would be set at 72° F. degrees Fahrenheit. In certain embodiments, the over cooling set point determined in step 312 may be used to control the dehumidification based cooling operation described below with respect to step 313.

In step 313, controller 200 may communicate a command to the HVAC system 100 to perform a dehumidification-based cooling procedure. For example, the dehumidification-based cooling procedure may comprise instructing the HVAC system 100 to perform a vapor compression refrigeration cycle to remove humidity from the air sent to the conditioned space by condensing the moisture in the air on the refrigerated evaporator. In certain embodiments, step 309 may comprise a first command communicated to HVAC system 100 and step 313 may comprise a second command communicated to HVAC system 100. In certain embodiments, the dehumidification-based cooling procedure may comprise continuing to perform the cooling operation of step 309. For example, if the cooling operation has already commenced for temperature control purposes, the cooling operation may continue to function for dehumidification purposes.

In certain embodiments, the dehumidification-based cooling procedure may also include reheating the air after condensing the moisture to remove humidity and before supplying the conditioned air to the zone. For example, if cooling the air to remove the humidity has caused the air to become too cold, then the dry, dehumidified air can be reheated to avoid making the conditioned space too cold for the user's comfort.

In certain embodiments, in step 313 controller 200 may determine that the humidity ratio threshold is unattainable. As discussed above, FIG. 3 illustrates an example in which the humidity ratio set point is used as the humidity ratio threshold. For example, the humidity ratio set point may be unattainable if the evaporator cannot be cooled to a temperature below the dew point, if HVAC system 100 cannot meet the demand (e.g., the rate of humidity infiltration exceeds the capacity of HVAC system 100 to remove moisture such as if a window or door is left open), or if HVAC system 100 cannot remove sufficient humidity within an over cooling limit. In certain embodiments, the over cooling limit can be configured to indicate a limit to the amount of additional cooling that can be provided for dehumidification purposes after the temperature falls below the temperature set point. As an example, suppose the temperature set point is set to 75° F. and the over cooling limit is set to 3° F. After cooling the zone to 72° F. (which corresponds to the temperature set point of 75° F. minus the over cooling limit of 3° F.), the over cooling limit set point as determined in step 312 will have been reached and HVAC system 100 may cease further cooling even if the humidity ratio set point has not been reached.

In certain embodiment, in step 313 if controller 200 determines that the humidity ratio set point is unattainable then controller 200 may determine not to perform the cooling operation. For example, if the cooling operation is already on then controller 200 may determine to communicate a command to HVAC system 100 to cease the cooling operation. In certain embodiments, in step 313 if controller 200 determines that the calculated humidity ratio set point (or threshold) is unattainable then controller 200 may calculate a new humidity ratio set point (or threshold) that is attainable and communicate a command to perform a dehumidification-based cooling procedure until the new humidity ratio set point (or threshold) has been reached.

In step 315 controller 200 may determine if either the temperature data is below the over-cooling set point from step 312 or if the humidity-ratio data is below the humidity-ratio set point. If neither of these conditions have been reached then controller 200 may return to step 313 to continue performing the dehumidification-based cooling operation. If either of the two conditions have been met then controller 200 may end method 300.

The method described with respect to FIG. 3 may have more or fewer steps, and the steps may be performed in any suitable order (e.g., step 305 may be performed after steps 307-309 and before step 311). As an example, steps 307-313 may be optional in certain embodiments or may performed in a single step in certain embodiments (e.g., controller 200 may determine whether the temperature threshold and the humidity ratio threshold have been met simultaneously or in the same step). As another example, step 315 may be optional where controller 200 performs a loop of method 300 rather than returning to step 313 to perform another instance of the dehumidification-based cooling operation.

Figure 4:
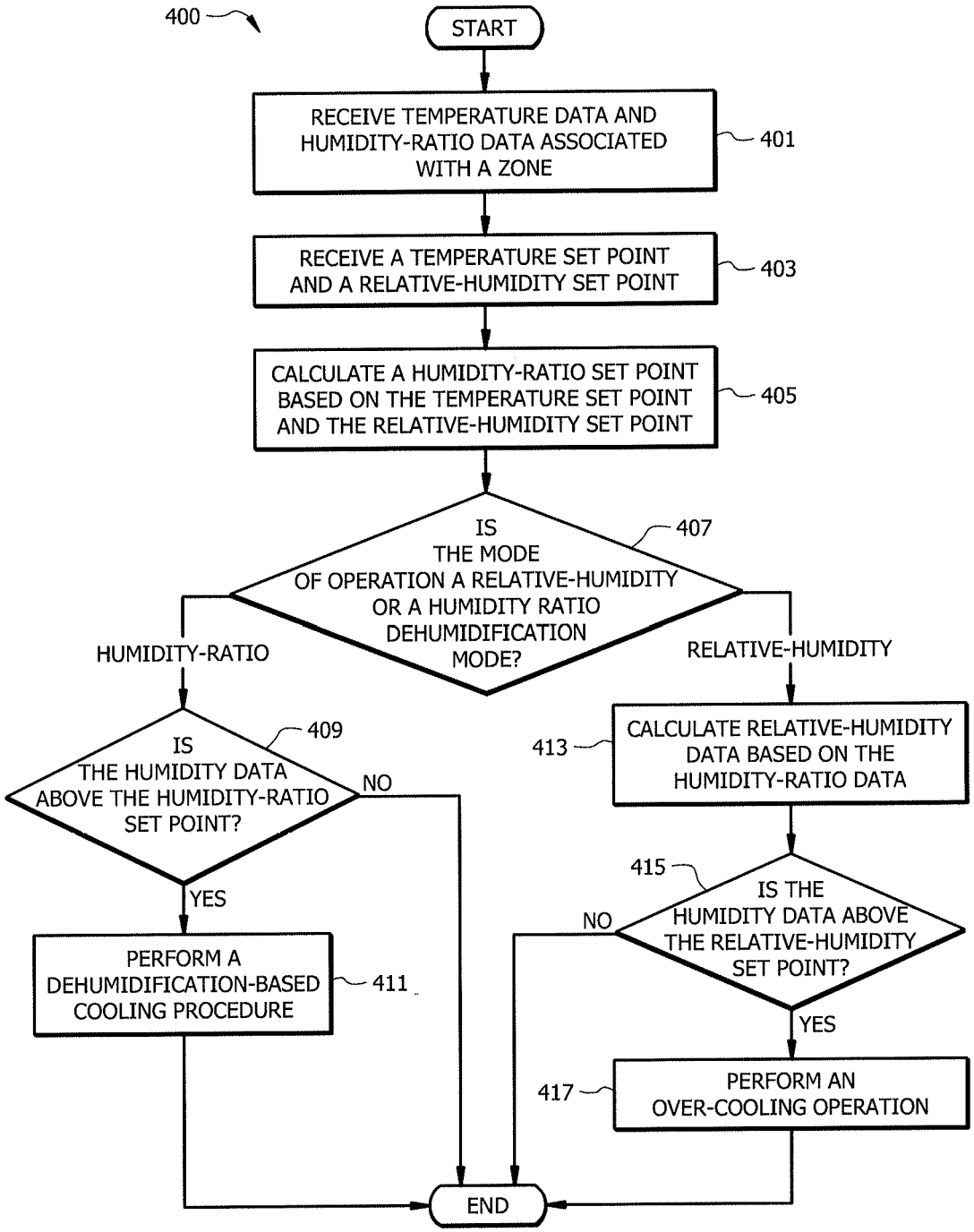
FIG. 4 is a flowchart illustrating a method that may be performed by an example HVAC system, in accordance with certain embodiments.

FIG. 4 illustrates an example method that may be performed by HVAC system 100. In particular embodiments, controller 200 or controller 201 may perform all of the steps of method 400. For simplicity, either controller 200 or controller 201 may be referred to simply as controller 200 for the following disclosed steps. In some embodiments, controller 200 initiates method 400 in step 401. In step 401, controller 200 may receive temperature data associated with a zone from a temperature sensor and humidity ratio data associated with a zone from a humidity sensor. In step 403, controller 200 may receive a desired temperature set point and a relative-humidity set point from a user. In step 405, controller 200 may calculate a humidity ratio set point based on the temperature set point and the relative humidity set point received in step 403. Steps 401, 403, and 405 of FIG. 4 are analogous to steps 301, 303, and 305 of FIG. 3, respectively. Thus, additional explanation of steps 401, 403, and 405 may be found in the discussion of FIG. 3 above.

In some embodiments, in step 407, controller 200 may determine if the user has selected a relative humidity based mode of operation or a humidity ratio based mode of operation for dehumidification purposes. In certain embodiments, the user may select the mode of operation for HVAC system 100. For example, a user may select a first mode of operation or a second mode of operation for HVAC system 100. In certain embodiments, the user may be presented with a set of modes that correspond to the relative humidity based mode of operation and the humidity ratio based mode of operation. For example, the relative humidity based mode of operation may be presented to the user as a "normal" mode and the humidity ratio based mode of operation may be presented to the user as an "efficiency" mode. In certain embodiments, in step 407, if the selected mode of operation is a humidity ratio based mode of operation, controller 200 may proceed to step 409. Otherwise, if the selected mode of operation is a relative humidity based mode of operation, controller 200 may proceed to step 413.

In some embodiments, controller 200 may perform energy savings calculations. For example, energy savings calculations may be based off of the additional energy that the HVAC system 100 would have to expend to operate in a relative humidity dehumidification mode as compared to the amount of energy that the HVAC system 100 would have to expend to operate in a humidity ratio dehumidification mode. By way of illustration, because the humidity ratio is based on an absolute value and will be fixed after calculating the relative humidity set point, an example HVAC system 100 would almost invariably reach the calculated humidity ratio set point before reaching the relative humidity set point. This is because relative humidity is a function of the temperature of the air, meaning that as an example HVAC system 100 attempts to further remove moisture from the air by condensing the moisture out of the air, the relative humidity value will tend to be influenced by the drop in air temperature. Thus, while sufficient moisture may have been removed to achieve the desired level of comfort, the HVAC system 100 may continue to operate since the relative humidity set point has not yet been reached, and may never be reached.

In certain embodiments, controller 200 may perform energy savings calculations based on historical averages in use of HVAC system 100 or based on predicted or projected use. In certain embodiments, controller 200 may perform energy savings calculations taking into account expected season changes. It is understood that the energy savings calculations between the various modes may be achieved by any suitable type of calculation. In certain embodiments, controller 200 may display energy savings calculations to a user to aid the user in selecting the appropriate mode.

As discussed above, if at step 407 controller 200 determines that the mode of operation corresponds to humidity ratio-based dehumidification, the method may proceed to steps 409 where controller 200 may determine if the humidity data in the form of humidity ratio data is above the humidity ratio threshold (i.e., the threshold that is based on the humidity ratio set point). For simplicity, FIG. 4 illustrates an example in which the humidity ratio threshold is the same as the humidity ratio set point. If the humidity data is above the humidity ratio set point, then controller 200 may proceed to step 411 to perform a dehumidification-based cooling procedure. Otherwise, if the humidity data is not above the humidity ratio set point, then controller 200 may end method 400. Steps 409 and 411 of FIG. 4 are analogous to steps 311 and 313 of FIG. 3, respectively. Thus, additional explanation of steps 409 and 411 may be found in the discussion of FIG. 3 above.

As discussed above, if at step 407 controller 200 determines that the mode of operation corresponds to relative humidity-based dehumidification, the method may proceed to steps 413 where controller 200 may calculate relative humidity data based on the humidity ratio data received from a humidity sensor in step 401. In step 415, controller 200 may determine if the relative humidity data calculated in step 413 is above the relative humidity set point received in step 403. If the relative humidity data is above the relative humidity set point, then controller 200 may proceed to step 417. Otherwise, if the humidity data is not above the humidity ratio set point, then controller 200 may end method 400.

In step 417, controller 200 may communicate a command to the HVAC system to perform an over-cooling operation that continues to cool the air for dehumidification purposes after the air has been cooled enough to satisfy the temperature set point. For example, the over-cooling operation may comprise commanding the HVAC system to perform a vapor compression refrigeration cycle to remove humidity from the air sent to the conditioned space by condensing the moisture in the air on the refrigerated evaporator beyond the point at which the temperature set point has been reached. In certain embodiments, the over-cooling operation may also include reheating the air before supplying the conditioned air to the zone after condensing the moisture to remove humidity. In certain embodiments, the dehumidification-based cooling procedure may comprise continuing to perform a cooling operation. For example, if the cooling operation has already commenced for temperature control purposes, the cooling operation may continue to function for dehumidification purposes.

In certain embodiments, after performing an over-cooling operation in step 417, controller 200 may again calculate the relative humidity data based on the humidity ratio data from the humidity sensor accounting for the change in temperature when recalculating the relative humidity data. The recalculation may be achieved by completing another iteration of method 400. For example, by cycling through method 400 while the selected operation mode is based on a relative humidity dehumidification mode, the HVAC system 100 may update and adjust the calculated relative humidity data (step 413) based on the humidity ratio data from the humidity sensor (step 401) and the air temperature from the temperature sensor (step 401). As discussed above, relative humidity data is a function of temperature such that the relative humidity tends to increase as temperature decreases.

In certain embodiments, the over-cooling operation may have a cut off temperature below which the over-cooling operation will be terminated regardless of having met the relative humidity threshold. For example, the over-cooling operation may have an over-cooling limit of three degrees so that if the temperature set point is seventy degrees and the relative humidity set point is thirty percent, the over-cooling operation will terminate when the temperature in the conditioned zone falls to sixty-seven degrees even if the relative humidity in the conditioned zone has not yet reached the thirty percent relative humidity set point.

The method described with respect to FIG. 4 may have more or fewer steps, and the steps may be performed in any suitable order (e.g., step 405 may be performed after step 407 and before step 409; step 413 may be performed between steps 410 and 407). Furthermore, steps 409-411 and steps 413-417 may be optional in certain embodiments or may performed in a single step in certain embodiments.

Modifications, additions, or omissions may be made to any of the methods disclosed herein. These methods may include more, fewer, or other steps, and steps may be performed in parallel or in any suitable order. Throughout the disclosure, the term HVAC is used in a general sense and refers to any system that functions to achieve dehumidification of a space. Examples include heat pump systems, air conditioning systems, combined heating-and-air conditioning systems, dehumidifier systems, and refrigeration systems. While certain components of the HVAC system controller have been described as performing certain steps, any suitable component or combination of components may perform one or more steps of these methods. Certain examples have been described using the modifiers "first" or "second" (e.g., first mode, second mode). Unless the context in which these modifiers appear indicates otherwise, the modifiers do not require any particular sequence of steps or arrangement of devices.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A heating ventilation and air conditioning (HVAC) system, the HVAC system comprising:

a controller;

a temperature sensor configured to communicate temperature data to the controller, the temperature data comprising a temperature of a zone;

a humidity sensor configured to communicate humidity data to the controller, the humidity data comprising a humidity-ratio of the zone; and the controller configured to:

receive temperature data from the temperature sensor;

receive humidity data from the humidity sensor;

receive a temperature set point and a relative-humidity set point from a user;

determine a humidity-ratio set point based on the received temperature set point and relative-humidity set point;

determine a temperature threshold range based on the temperature set point and a rate of change of the received temperature data over time, the temperature threshold range corresponding to a range of temperature values;

determine a humidity-ratio threshold range based on the determined humidity-ratio set point, the humidity-ratio threshold range corresponding to a range of humidity-ratio values;

upon determining that the temperature data exceeds the temperature threshold range, communicate a command to the HVAC system to perform a cooling operation;

upon determining that the temperature data is within the temperature threshold range, determine if the humidity data is within the humidity-ratio threshold range; and upon determining that the humidity data is outside the humidity-ratio threshold range, operate the HVAC system according to a dehumidification-based cooling procedure.

2. The HVAC system of claim 1, wherein the controller is further configured to operate the HVAC system according to the dehumidification-based cooling procedure by causing the HVAC system to perform the cooling operation until the humidity-ratio data is within the humidity-ratio threshold range.

3. The HVAC system of claim 1, wherein the controller is further configured to operate the HVAC system according to the dehumidification-based cooling procedure by:

determining that the humidity-ratio threshold range is unattainable;

upon determining that the humidity-ratio threshold range is unattainable, determining a new humidity-ratio threshold range that is attainable; and performing the cooling mode operation until the new humidity-ratio threshold range is met.

4. The HVAC system of claim 1, wherein the controller is further configured to:

determine, based on a user input, whether to operate the HVAC system according to a first mode of operation that uses relative-humidity to determine whether to perform dehumidification or a second mode of operation that uses humidity-ratio to determine whether to perform dehumidification; and operate the HVAC system according to the determined mode of operation.

5. The HVAC system of claim 4, wherein:

the determined mode of operation is the first mode of operation; and the controller is further configured to operate the HVAC system according to the first mode of operation by:

calculating relative-humidity data based at least on the humidity data; and upon determining that the relative-humidity data has not reached a relative-humidity threshold range that is based on the relative-humidity set point, operate the HVAC system according to an over-cooling operation.

6. The HVAC system of claim 4, wherein the controller is further configured to:

perform a plurality of energy savings calculations, the energy savings calculations based at least in part on whether the first mode of operation or the second mode of operation is selected; and display results of the energy savings calculations.

7. The HVAC system of claim 1, wherein the controller is further configured to operate the HVAC system according to the dehumidification-based cooling procedure by:

determining that a temperature of an evaporator coil is above a dew point; and upon determining that the temperature of the evaporator coil is above the dew point, determine not to perform the cooling operation.

8. A controller for an HVAC system, the controller comprising:

one or more interfaces configured to:

receive temperature data from a temperature sensor, the temperature data comprising a temperature of a zone;

receive humidity data from a humidity sensor, the humidity data comprising a humidity-ratio of the zone; and receive a temperature set point and a relative-humidity set point from a user; and processing circuitry configured to:

determine a humidity-ratio set point based on the received temperature set point and relative-humidity set point;

determine a temperature threshold range based on the temperature set point and a rate of change of the received temperature data over time, the temperature threshold range corresponding to a range of temperature values;

determine a humidity-ratio threshold range based on the determined humidity-ratio set point, the humidity-ratio threshold range corresponding to a range of humidity-ratio values;

upon determining that the temperature data exceeds the temperature threshold range, communicate a command to the HVAC system to perform a cooling operation;

upon determining that the temperature data is within the temperature threshold range, determine if the humidity data is within the humidity-ratio threshold range; and upon determining that the humidity data is outside the humidity-ratio threshold range, operate the HVAC system according to a dehumidification-based cooling procedure.

9. The controller of claim 8, the processing circuitry further configured to operate the HVAC system according to the dehumidification-based cooling procedure by causing the HVAC system to perform the cooling operation until the humidity-ratio data is within the humidity-ratio threshold range.

10. The controller of claim 8, wherein the processing circuitry is further configured to operate the HVAC system according to the dehumidification-based cooling procedure by:

determining that the humidity-ratio threshold range is unattainable;

upon determining that the humidity-ratio threshold range is unattainable, determining a new humidity-ratio threshold range that is attainable; and performing the cooling mode oration until the new humidity-ratio threshold range is met.

11. The controller of claim 8, wherein the processing circuitry is further configured to:

determine, based on a user input, whether to operate the HVAC system according to a first mode of operation that uses relative-humidity to determine whether to perform dehumidification or a second mode of operation that uses humidity-ratio to determine whether to perform dehumidification; and operate the HVAC system according to the determined mode of operation.

12. The controller of claim 11, wherein:

the determined mode of operation is the first mode of operation; and the processing circuitry is further configured to operate the HVAC system according to the first mode of operation by:

calculating relative-humidity data based at least on the humidity data; and upon determining that the relative-humidity data has not reached a relative-humidity threshold range that is based on the relative-humidity set point, operate the HVAC system according to an over-cooling operation.

13. The controller of claim 11, wherein the processing circuitry is further configured to:

perform a plurality of energy savings calculations, the energy savings calculations based at least in part on whether the first mode of operation or the second mode of operation is selected; and display results of the energy savings calculations.

14. The controller of claim 8, wherein the processing circuitry is further configured to operate the HVAC system according to the dehumidification-based cooling procedure by:

determining that a temperature of an evaporator coil is above a dew point; and upon determining that the temperature of the evaporator coil is above the dew point, determine not to perform the cooling operation.

15. A method of operating an HVAC system comprising:

receiving temperature data from a temperature sensor, the temperature data comprising a temperature of a zone;

receiving humidity data from a humidity sensor, the humidity data comprising a humidity-ratio of the zone;

receiving a temperature set point and a relative-humidity set point from a user;

determining a humidity-ratio set point based on the received temperature set point and relative-humidity set point;

determining a temperature threshold range based on the temperature set point and a rate of change of the received temperature data over time, the temperature threshold range corresponding to a ran e of temperature values;

determining a humidity-ratio threshold ran e based on the determined humidity-ratio set point, the humidity-ratio threshold range corresponding to a range of humidity-ratio values;

upon determining that the temperature data exceeds the temperature threshold range, communicating a command to the HVAC system to perform a cooling operation;

upon determining that the temperature data is within the temperature threshold range, determining if the humidity data is within the humidity-ratio threshold range; and upon determining that the humidity data is outside the humidity-ratio threshold range, operating the HVAC system according to a dehumidification-based cooling procedure.

16. The method of claim 15, wherein operating the HVAC system according to the dehumidification-based cooling procedure comprises performing the cooling operation until the humidity-ratio data is within the humidity-ratio threshold range.

17. The method of claim 15, wherein operating the HVAC system according to the dehumidification-based cooling procedure comprises:

determining that the humidity-ratio threshold range is unattainable;

upon determining that the humidity-ratio threshold range is unattainable, determining a new humidity-ratio threshold range that is attainable; and performing the cooling mode operation until the new humidity-ratio threshold range is met.

18. The method of claim 15, further comprising:

determining, based on a user input, whether to operate the HVAC system according to a first mode of operation that uses relative-humidity to determine whether to perform dehumidification or a second mode of operation that uses humidity-ratio to determine whether to perform dehumidification; and operating the HVAC system according to the determined mode of operation.

19. The method of claim 18, wherein:

the determined mode of operation is the first mode of operation; and operating the HVAC system according to the first mode of operation comprises:

calculating relative-humidity data based at least on the humidity data; and upon determining that the relative humidity data has not reached a relative humidity threshold range that is based on the relative-humidity set point, operating the HVAC system according to an over-cooling operation.

20. The method of claim 18, further comprising:

performing a plurality of energy savings calculations, the energy savings calculations based at least in part on whether the first mode of operation or the second mode of operation is selected; and displaying results of the energy savings calculations.

* * * * *